US010161109B2

(12) United States Patent
Iwasaki

(10) Patent No.: US 10,161,109 B2
(45) Date of Patent: Dec. 25, 2018

(54) HYDRAULIC CIRCUIT FOR CONSTRUCTION MACHINE

(71) Applicant: NABTESCO CORPORATION, Tokyo (JP)

(72) Inventor: Hitoshi Iwasaki, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 202 days.

(21) Appl. No.: 15/323,335

(22) PCT Filed: May 26, 2015

(86) PCT No.: PCT/JP2015/065095
§ 371 (c)(1),
(2) Date: Dec. 30, 2016

(87) PCT Pub. No.: WO2016/002392
PCT Pub. Date: Jan. 7, 2016

(65) Prior Publication Data
US 2017/0145661 A1 May 25, 2017

(30) Foreign Application Priority Data
Jul. 3, 2014 (JP) ..... 2014-137987

(51) Int. Cl.
*F15B 11/024* (2006.01)
*E02F 9/22* (2006.01)
(Continued)

(52) U.S. Cl.
CPC ..... *E02F 9/2242* (2013.01); *E02F 3/425* (2013.01); *E02F 9/22* (2013.01); *E02F 9/2292* (2013.01);
(Continued)

(58) Field of Classification Search
CPC ..... F15B 11/024; F15B 2211/45
See application file for complete search history.

(56) References Cited

U.S. PATENT DOCUMENTS 7,562,615 B2 * 7/2009 Abe ..... E02F 9/2203 91/436

FOREIGN PATENT DOCUMENTS

JP 2004-316839 A 11/2004
JP 2009-299719 A 12/2009
(Continued)

OTHER PUBLICATIONS

International Preliminary Report on Patentability and the Written Opinion of the International Searching Authority as issued in International Patent Application No. PCT/JP2015/065095, dated Jan. 3, 2017.
(Continued)

*Primary Examiner* — F. Daniel Lopez
(74) *Attorney, Agent, or Firm* — Pillsbury Winthrop Shaw Pittman, LLP

(57) ABSTRACT

A recycling passage 71 is configured to perform "pressure oil recycling," in which the recycling passage 71 feeds boom discharge oil 35Fo (recycling discharge oil) discharged from a boom cylinder 23F (a recycling actuator), to the boom cylinder 23F (an actuator actuated with feeding of discharge oil from a second pump 12). A first sensing pressure rising passage 81 feeds a part of boom discharge oil 35Fo to a first unload passage 31 upstream of a first pressure sensing point 61*p* when the pressure oil recycling is performed.

7 Claims, 7 Drawing Sheets

(51) Int. Cl.

| | |
|---|---|
| ***F15B 11/00*** | (2006.01) |
| ***F15B 11/17*** | (2006.01) |
| ***E02F 3/42*** | (2006.01) |

(52) U.S. Cl.

CPC ..... *F15B 11/00* (2013.01); *F15B 11/024* (2013.01); *F15B 11/17* (2013.01); *F15B 2211/20576* (2013.01); *F15B 2211/255* (2013.01); *F15B 2211/3059* (2013.01); *F15B 2211/45* (2013.01); *F15B 2211/6306* (2013.01); *F15B 2211/6652* (2013.01); *F15B 2211/6654* (2013.01)

(56) References Cited

FOREIGN PATENT DOCUMENTS

| | | | |
|---|---|---|---|
| JP | 2010-078035 | A | 4/2010 |
| JP | 2011-127727 | A | 6/2011 |
| JP | 2013-053498 | A | 3/2013 |
| JP | 5357864 | B2 | 12/2013 |
| WO | 00/65239 | A1 | 11/2000 |
| WO | 2009/123047 | A1 | 10/2009 |

OTHER PUBLICATIONS

International Search Report as issued in International Patent Application No. PCT/JP2015/065095, dated Jul. 14, 2015.
Extended European Search Report EP 15815795.8 dated Mar. 6, 2018.

* cited by examiner

HYDRAULIC CIRCUIT FOR CONSTRUCTION MACHINE

CROSS-REFERENCE TO RELATED APPLICATIONS

This application is the U.S. National Stage of PCT/JP2015/065095, filed May 26, 2015, which in turn claims priority to Japanese Patent Application No. JP 2014-137987, filed Jul. 3, 2014. The contents of these applications are incorporated herein by reference in their entireties.

TECHNICAL FIELD

The present invention relates to a hydraulic circuit for a construction machine.

BACKGROUND

Patent Literature 1 discloses a technique of reusing an oil discharged from an actuator (a technique of recycling a pressure oil). In the technique disclosed in this literature, the amount of charge (the discharge rate) of each of two pumps (12L, 12R) is individually controlled by the negative control. More specifically, claim 1 of the above literature recites as follows. "The pressure oil flowing out from a bottom-side oil chamber of a boom cylinder is allowed to flow into another hydraulic actuator, and the discharge rate reduction unit reduces the discharge rates of the main pumps." The above literature also discloses in paragraph 0019 as follows. "The flow of the pressure oil discharged from the main pumps (12L, 12R) is restricted by the negative control throttles (20L, 20R), . . . the negative control throttles (20L, 20R) produce a control pressure (hereinafter referred to as "a negative control pressure") for controlling regulators (13L, 13R)." The above literature also discloses in paragraph 0021 as follows. "The regulators (13L, 13R) reduce the discharge rates of the main pumps (12L, 12R) as the negative control pressure introduced thereto is larger, and these regulators increase the discharge rates of the main pumps (12L, 12R) as the negative control pressure introduced thereto is smaller." The reference signs in the above literature are enclosed within parentheses.

RELEVANT REFERENCES

List of Relevant Patent Literature

Patent Literature 1: Japanese Patent Application Publication No. 2013-53498

In the technique disclosed in Patent Literature 1, the discharge rates of the two pumps (12L, 12R) are individually controlled. It may also be possible that the discharge rates of the two pumps (a first pump and a second pump) are controlled in association with each other. Suppose that the above-described pressure oil recycling is conducted and therefore the second pump feeds excess discharge oil (a smaller amount of discharge oil is required). Since the discharge rates of the first pump and the second pump are controlled in association with each other, the excess discharge rate of the second pump may not be properly reduced. For a specific example, the above problem may occur in the case where the discharge oil from the first pump is fed to the actuator and the discharge rate of the second pump is determined based on the required amount of discharge oil from the first pump. As a result, energy may be wasted for actuating the second pump.

One object of the present invention is to provide a hydraulic circuit for a construction machine configured such that the discharge rates of a fist pump and a second pump are controlled in association with each other and further configured such that the pressure oil recycling is conducted to facilitate reduction of the discharge rate of the second pump when the second pump has excess discharge oil, thereby to restrain energy consumption.

SUMMARY

A hydraulic circuit for a construction machine of the present invention may be connected to a first pump, a second pump, a tank, and a plurality of actuators. The hydraulic circuit for a construction machine may include a first unload passage connected to the first pump, a second unload passage connected to the second pump, a first unload passage, a second unload passage, and a tank passage connected to the tank. The hydraulic circuit for a construction machine may further include directional control valves, a negative control pressure sensing unit, a regulator, a recycling passage, and sensing pressure rising passages. The directional control valves may be connected to the plurality of actuators, respectively, and configured to feed an oil from the first pump or the second pump to the plurality of actuators and discharge to the tank the oil discharged from the plurality of actuators. The negative control pressure sensing unit may output, as a negative control pressure, the lower one of the pressure sensed at the first pressure sensing point in the most downstream portion of the first unload passage and the pressure sensed at the second pressure sensing unit in the most downstream portion of the second unload passage. The regulator may be configured to control discharge rates of the first pump and the second pump in association with each other in accordance with the negative control pressure output from the negative control pressure sensing unit. The recycling passage may be connected to a recycling actuator included in the plurality of actuators. The sensing pressure rising passage may be connected to the recycling actuator. The plurality of directional control valves may include a recycling directional control valve configured to feed discharge oil from the second pump to the recycling actuator. The recycling passage may be configured to perform pressure oil recycling, in which the recycling passage feeds recycling discharge oil discharged from the recycling actuator, to the actuator actuated with feeding of the discharge oil from the second pump. The sensing pressure rising passage may be configured to feed a part of the recycling discharge oil to the first unload passage upstream at the first pressure sensing point or the second unload passage upstream at the second pressure sensing point when the pressure oil recycling is performed.

With the above arrangement, it may be possible to provide a hydraulic circuit for a construction machine configured such that the discharge rates of a fist pump and a second pump are controlled in association with each other and, when the pressure oil recycling is conducted and the second pump has excess discharge oil, the discharge rate of the second pump can be readily reduced to restrain energy consumption.

DESCRIPTION OF EXAMPLE EMBODIMENTS

First Embodiment

Figure 1:
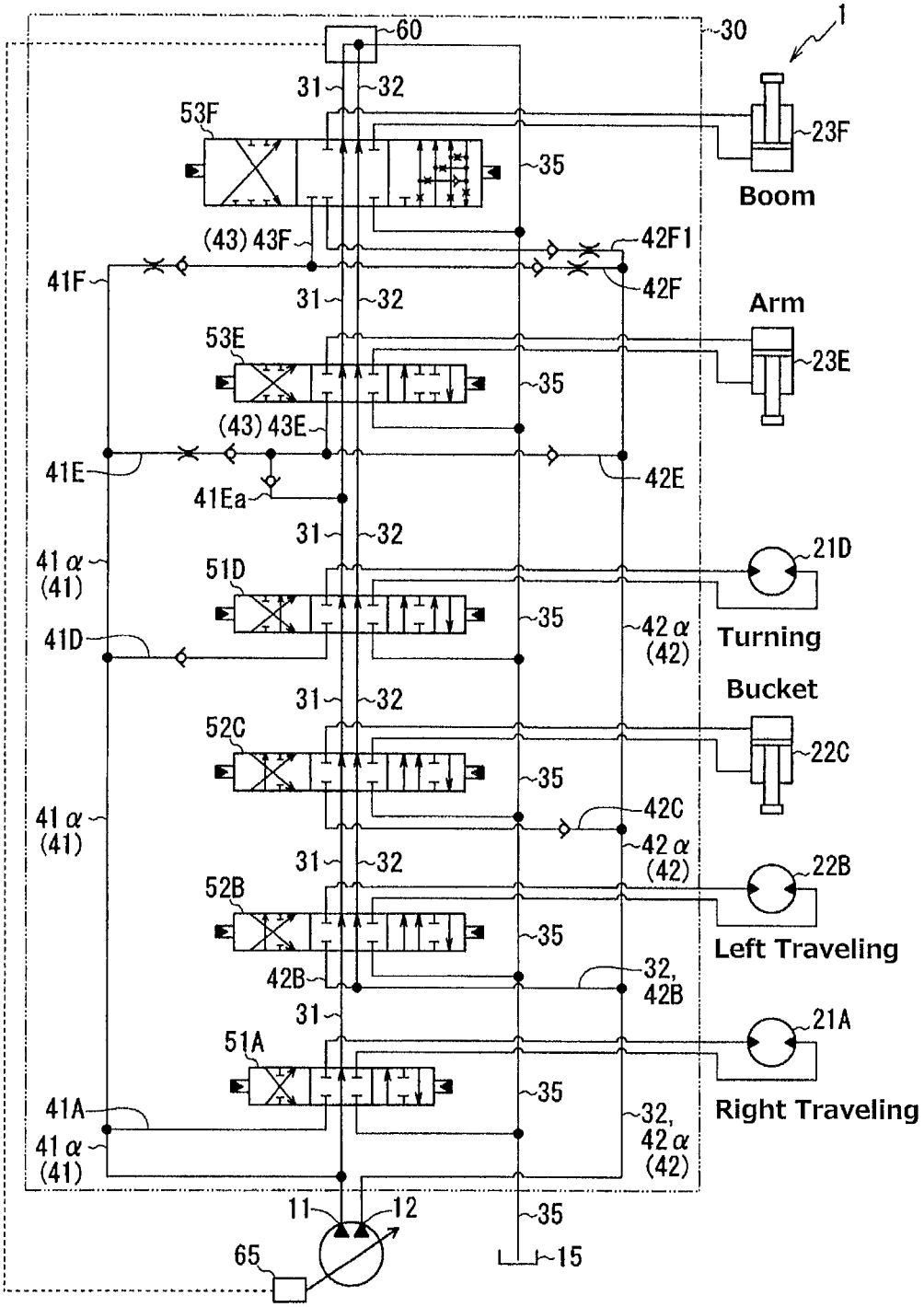
FIG. 1 is a hydraulic circuit diagram of a construction machine 1 including a hydraulic circuit 30 for a construction machine.

A construction machine 1 including a hydraulic circuit 30 for a construction machine shown in FIG. 1 will be described with reference to FIGS. 1 to 3.

The construction machine 1 may serve for construction works. Examples of the construction machine 1 may include a hydraulic shovel. The construction machine 1 may include pumps 11, 12, a tank 15, actuators 21A to 23F, and the hydraulic circuit 30 for a construction machine.

The pumps 11, 12 may be hydraulic pumps for discharging an oil (pressure oil, hydraulic oil). The pumps 11, 12 may have a variable capacity. In the pumps 11, 12, the capacity may be varied by varying the tilt angle of a swash plate, and the discharge rate (the amount of discharge oil for one rotation of an input shaft) may be varied as the capacity is varied. The pumps 11, 12 may be constituted by two pumps. The pumps 11, 12 may include a first pump 11 and a second pump 12. Examples of the pumps 11, 12 may include a split pump. A split pump may include one input shaft and a plurality of pumps (the first pump 11 and the second pump 12) actuated by the input shaft. The split pump may include the first pump 11 and the second pump 12 integrated together. In the split pump, the first pump 11 and the second pump 12 may have the same discharge rate. It may also be possible that the pumps 11, 12 are not constituted by a split pump. The first pump 11 and the second pump 12 may be separate from each other. The first pump 11 and the second pump 12 may have either a common input shat or respective input shafts. The first pump 11 and the second pump 12 may have either the same discharge rate or different discharge rates.

The tank 15 may store an oil. The tank 15 may feed the oil to the pumps 11, 12. The oil discharged from the pumps 11, 12 and passed through the actuators 21A to 23F may return to the tank 15. The oil discharged from the pumps 11, 12 and not passed through the actuators 21A to 23F may return to the tank 15.

The actuators 21A to 23F may actuate the construction machine 1. The actuators 21A to 23F may be hydraulic actuators actuated by the oil fed from the pump 11, 12. Types of the actuators 21A to 23F may include hydraulic motors and hydraulic cylinders. If the construction machine 1 is a hydraulic shovel, the actuators 21A to 23F may be used for traveling, turning, bucket rotation, arm luffing, and boom luffing, etc. The actuators 21A to 23F may include first actuators 21A, 21D, second actuators 22B, 22C, and third actuators 23E, 23F.

The first actuators 21A, 21D may be actuated by the oil fed from the first pump 11. The first actuators 21A, 21D may not be fed with the oil from the second pump 12. The first actuators 21A, 21D may include a right traveling motor 21A (one traveling motor) and a turning motor 21D.

The right traveling motor 21A (one traveling motor) may be a hydraulic motor for traveling of the construction machine 1. The right traveling motor 21A may be a hydraulic motor for actuating a crawler in the right side of a base carrier included in the construction machine 1.

The turning motor 21D may be a hydraulic motor for turning of the super structure relative to the base carrier.

The second actuators 22B, 22C may be actuated by the oil fed from the second pump 12. The second actuators 22B, 22C may not be fed with the oil from the first pump 11. The second actuators 22B, 22C may include a left traveling motor 22B (the other traveling motor) and a bucket cylinder 22C.

The left traveling motor 22B (the other traveling motor) may be a hydraulic motor for traveling of the construction machine 1. The left traveling motor 22B may be a motor for actuating a crawler in the left side of the base carrier included in the construction machine 1. It may also be possible that the right traveling motor 21A is included in the second actuator and the left traveling motor 22B is included in the first actuator.

The bucket cylinder 22C may be a hydraulic cylinder for rotating the bucket relative to the arm.

The third actuators 23E, 23F may be fed with the oil from the first pump 11 and may be fed with the oil from the second pump 12. The third actuators 23E, 23F may be actuated by the oil fed from both or one of the first pump 11 and the second pump 12. The third actuators 23E, 23F may include an arm cylinder 23E and a boom cylinder 23F (a recycling actuator).

The arm cylinder 23E may serve to luff (raise, lower, and rotate) the arm relative to the boom.

The boom cylinder 23F (the recycling actuator) may serve to luff (raise, lower, and rotate) the boom relative to the super structure. In lowering the boom, the boom cylinder 23F may operate in the same manner as the second actuator (described later). The construction machine 1 may also include actuators other than the actuators 21A to 23F (e.g., actuators for a dozer). The boom cylinder 23F may be "the recycling actuator." The recycling actuator refers to an actuator that may discharge an oil flowing into a recycling passage 71 (shown in FIG. 3 and described later).

The hydraulic circuit 30 for a construction machine may serve to control the operation of the plurality of actuators 21A to 23F. The hydraulic circuit 30 for a construction machine may be connected to a first pump 11, a second pump 12, a tank 15, and a plurality of actuators 21A to 23F. The hydraulic circuit 30 for a construction machine may be integrally constructed, for example, in a block shape (substantially rectangular parallelepiped shape). The hydraulic circuit 30 for a construction machine may include a plurality of directional control valves 51A to 53F as described later, and the hydraulic circuit 30 for a construction machine as a whole may be referred to as a "directional control valve." The hydraulic circuit 30 for a construction machine may include passages 31 to 43, directional control valves 51A to 53F, a negative control pressure sensing unit 60, a regulator 65, a recycling passage 71 shown in FIG. 2, and sensing pressure rising passages 81, 82.

As shown in FIG. 1, the passages 31 to 43 may be oil passages (oil passages, pipes). The passages 31 to 43 may include unload passages 31, 32, a tank passage 35, and feeding passages 41, 42, and 43.

The unload passages 31, 32 may be passages (bypass passages) for returning the discharge oil from the pumps 11, 12 to the tank 15, instead of feeding the discharge oil to the actuators 21A to 23F. However, when the oil flows from the first unload passage 31 to a first arm-related joining passage 41Ea (described later), the discharge oil from the pumps 11, 12 may be fed to the actuators 21A to 23F. In addition, when the sensing pressure rising passages 81, 82 (described later) are used, the oil may be fed from the actuators 21A to 23F (for example, the boom cylinder 23F) to the unload passages 31, 32. The unload passages 31, 32 may include two unload passages (the hydraulic circuit 30 for a construction machine may have a so-called dual bypass system). The unload passages 31, 32 may include a first unload passage 31 and a second unload passage 32. The first unload passage 31 may be connected to the first pump 11. The second unload passage 32 may be connected to the second pump 12. As shown in FIG. 2, the first unload passage 31 may be provided with a first relief valve 31*r*. The second unload passage 32 may be provided with a second relief valve 32*r*.

The first relief valve 31*r* may be disposed on the most downstream portion of the first unload passage 31. The "most downstream portion" refers to a portion downstream of the directional control valve (the arm-related directional control valve 53E in FIG. 1) located most downstream (most distant from the pumps 11, 12) among the plurality of directional control valves 51A to 53F. When the pressure in the most downstream portion of the first unload passage 31 exceeds a first relief pressure (described later), the first relief valve 31*r* shown in FIG. 2 may cause the oil in the most downstream portion of the first unload passage 31 to be discharged into the tank 15. The first relief pressure may be preset in the first relief valve 31*r*. The second relief valve 32*r* may be disposed on the most downstream portion of the second unload passage 32. When the pressure in the most downstream portion of the second unload passage 32 exceeds a second relief pressure (described later), the second relief valve 32*r* may cause the oil in the most downstream portion of the second unload passage 32 to be discharged into the tank 15. The second relief pressure may be preset in the second relief valve 32*r*.

As shown in FIG. 1, the tank passages 35 may serve to return the oil to the tank 15. The tank passage 35 may be connected to the tank 15, the first unload passage 31, and the second unload passage 32. The tank passage 35 may be connected to each of the plurality of directional control valves 51A to 53F. The tank passage 35 may be connected to the most downstream portions of the first unload passage 31 and the second unload passage 32. As shown in FIG. 2, the tank passage 35 may include an arm-related tank passage 35E and a boom-related tank passage 35F. The arm-related tank passage 35E may serve to return the oil discharged from an arm cylinder 23E (described later) to the tank 15. The boom-related tank passage 35F may serve to return the boom discharge oil 35Fo (the recycling discharge oil) (see FIG. 3) discharged from a boom cylinder 23F (described later) to the tank 15.

As shown in FIG. 1, the feeding passages 41, 42, 43 may serve to feed the discharge oil from the pumps 11, 12 to the actuators 21A to 23F. The feeding passages 41, 42, 43 may include a first feeding passage 41, a second feeding passage 42, and a third feeding passage 43.

The first feeding passage 41 may serve to feed the discharge oil from the first pump 11 to the first actuators 21A, 21D and the third actuators 23E, 23F (the third feeding passage 43 may not be included in the first feeding passage 41). The first feeding passage 41 may be connected to the first pump 11. The first feeding passage 41 may be connected to the first unload passage 31. The first feeding passage 41 may be connected to the most upstream portion of the first unload passage 31. The "most upstream portion of the first unload passage 31" refers to a portion on the upstream side (the first pump 11 side) of the directional control valve (the right traveling directional control valve 51A in FIG. 1 (one traveling directional control valve)) located most upstream among the directional control valves 51A to 53F (described later) passed by the first unload passage 31. The first feeding passage 41 may include a first feeding main passage 41α, first feeding branch passages 41A to 41F, and a first arm-related joining passage 41Ea.

The first feeding main passage 41*a* may serve to feed the oil to two or more of the first directional control valves 51A, 51D and the third directional control valves 53E, 53F.

The first feeding branch passages 41A to 41F may serve to feed the oil to only one of the first directional control valves 51A, 51D and the third directional control valves 53E, 53F (any one of the directional control valves 51A, 51D, 53E, 53F). The first feeding branch passages 41A to 41F may be connected to the first feeding main passage 41α. The first feeding branch passages 41A to 41F may include a right traveling branch passage 41A (one traveling branch passage), a turning branch passage 41D, a first boom-related branch passage 41F, and a first arm-related branch passage 41E. The first boom-related branch passage 41F may connect between the first feeding main passage 41α and the boom-related feeding passage 43F (described later). The first arm-related branch passage 41E may connect between the first feeding main passage 41α and the arm-related feeding passage 43F (described later).

The first arm-related joining passage 41Ea may serve to feed (join) the oil (excess oil) flowing through the first unload passage 31 to the arm-related feeding passage 43E (the third feeding passage 43). The first arm-related joining passage 41Ea may be connected to the first unload passage 31 and the arm-related feeding passage 43E (the third feeding passage 43). In addition to the first arm-related joining passage 41Ea, there may be another joining passage for feeding the oil flowing through the unload passages 31, 32 to the feeding passages 41, 42, 43.

The second feeding passage 42 may serve to feed the discharge oil from the second pump 12 to the second actuators 22B, 22C and the third actuators 23E, 23F (the third feeding passage 43 may not be included in the second feeding passage 42). The second feeding passage 42 may be connected to the second pump 12. The second feeding passage 42 may be connected to the second unload passage 32. The second feeding passage 42 may be connected to the most upstream portion of the second unload passage 32. The "most upstream portion of the second unload passage 32" refers to a portion on the upstream side (the second pump 12 side) of the directional control valve (the left traveling directional control valve 52B in FIG. 1 (the other traveling directional control valve)) located most upstream among the directional control valves 52B to 53F (described later) passed by the second unload passage 32. The second feeding passage 42 may include a second feeding main passage 42α, second feeding branch passages 42B to 42F.

The second feeding main passage 42α may serve to feed the oil to two or more of the second directional control valves 52B, 52C and the third directional control valves 53E, 53F.

The second feeding branch passages 42B to 42F may serve to feed the oil to only one of the second directional control valves 52B, 52C and the third directional control valves 53E, 53F (any one of the directional control valves 52B, 52C, 53E, 53F). The second feeding branch passages 42B to 42F may be connected to the second feeding main passage 42*a*. The second feeding branch passages 42B to 42F may include a left traveling branch passage 42B (the other traveling branch passage), a bucket-related branch passage 42C, a second boom-related branch passage 42F, a boom-lowering branch passage 42F1, and a second arm-related branch passage 42E. The second boom-related branch passage 42F may connect between the second feeding main passage 42α and the boom-related feeding passage 43F (described later). The second arm-related branch passage 42E may connect between the second feeding main passage 42α and the arm-related feeding passage 43E (described later).

The third feeding passage 43 may serve to feed the discharge oil from the first pump 11 and the second pump 12 to the third actuators 23E, 23F. The third feeding passage 43 may include the first feeding passage 41 and the second feeding passage 42. The third feeding passage 43 may convey the joined flow of the oil flowing through the first feeding passage 41 and the oil flowing through the second feeding passage 42. The third feeding passage 43 may include the arm-related feeding passage 43E and the boom-related feeding passage 43F.

The arm-related feeding passage 43E may be connected to the arm-related directional control valves 53E (described later). The arm-related feeding passage 43E may be connected to the first arm-related branch passage 41E and the second arm-related branch passage 42E.

The boom-related feeding passage 43F may be connected to the boom-related directional control valves 53F (described later). The boom-related feeding passage 43F may be connected to the first boom-related branch passage 41F and the second boom-related branch passage 42F.

The passages 31 to 43 may be provided with check valves. The check valves may prevent backflow of the oil from the directional control valves 52C, 51D, 53E, 53F to the feeding passages 41, 42 and the unload passages 31, 32. The check valves may be disposed on, for example, the first feeding branch passages (the turning branch passage 41D, the first boom-related branch passage 41F, and the first arm-related branch passage 41E), the second feeding branch passages (the bucket-related branch passage 42C, the second boom-related branch passage 42F, the boom-lowering branch passage 42F1, and the second arm-related branch passage 42E), and the joining passage (the first arm-related joining passage 41Ea, etc.).

The directional control valves 51A to 53F may vary the flow rate and direction of the oil fed from the pumps 11, 12 to the actuators 21A to 23F (adjust the flow rate, and switch the direction). The directional control valves 51A to 53F may be connected to the plurality of actuators 21A to 23F, respectively, and may serve to feed and discharge the oil to and from the actuators 21A to 23F. The directional control valves 51A to 53F may feed the discharge oil from the pumps 11, 12 to the actuators 21A to 23F. The directional control valves 51A to 53F may discharge (return) the oil discharged from the actuators 21A to 23F, to the tank 15. The directional control valves 51A to 53F may be disposed between the pumps 11, 12 and the actuators 21A to 23F. Each of the directional control valves 51A to 53F may be constituted by a spool valve. A spool valve may vary the flow rate and the direction of the oil in accordance with the stroke (the position) of a spool.

The directional control valves 51A to 53F may include the first directional control valves 51A, 51D, the second directional control valves 52B, 52C, and the third directional control valves 53E, 53F. The directional control valves 51A to 53F may include the right traveling directional control valve 51A, the left traveling directional control valve 52B, the bucket-related directional control valve 52C, the turning directional control valve 51D, the arm-related directional control valve 53E, and the boom-related directional control valve 53F, and these directional control valves may be arranged in the above order from the upstream side to the downstream side of the unload passages 31, 32.

The first directional control valves 51A, 51D may vary the flow rate and the direction of the oil flowing from the first pump 11 to the first actuators 21A, 21D. The first directional control valves 51A, 51D may feed and discharge the oil to and from the first actuators 21A, 21D. The first directional control valves 51A, 51D may be connected to the first feeding passage 41, the first unload passage 31, and the tank passage 35. The first directional control valves 51A, 51D may be connected to the second unload passage 32 (see the turning directional control valve 51D) and may not be connected to the second unload passage 32 (see the right traveling directional control valve 51A). The first directional control valves 51A, 51D may include the right traveling directional control valve 51A and the turning directional control valve 51D.

The right traveling directional control valve 51A (one traveling directional control valve) may feed and discharge the oil to and from the right traveling motor 21A. The right traveling directional control valve 51A may be connected to the right traveling branch passage 41A.

The turning directional control valve 51D may feed and discharge the oil to and from the turning motor 21D. The turning directional control valve 51D may be connected to the turning branch passage 41D.

The second directional control valves 52B, 52C may vary the flow rate and the direction of the oil flowing from the second pump 12 to the second actuators 22B, 22C. The second directional control valves 52B, 52C may feed and discharge the oil to and from the second actuators 22B, 22C. The second directional control valves 52B, 52C may be connected to the second feeding passage 42, the second unload passage 32, and the tank passage 35. The second directional control valves 52B, 52C may be connected to the first unload passage 31. The second directional control valves 52B, 52C may not be connected to the first unload passage 31 (not shown). The second directional control valves 52B, 52C may include the left traveling directional control valve 52B and the bucket-related directional control valve 52C.

The left traveling directional control valve 52B (the other traveling directional control valve) may feed and discharge the oil to and from the left traveling motor 22B. The left traveling directional control valve 52B may be connected to the left traveling branch passage 42B.

The bucket-related directional control valve 52C may feed and discharge the oil to and from the bucket cylinder 22C. The bucket-related directional control valve 52C may be connected to the bucket-related branch passage 42C.

The third directional control valves 53E, 53F may vary the flow rate and the direction of the oil flowing from the first pump 11 and the second pump 12 to the third actuators 23E, 23F. The third directional control valves 53E, 53F may feed and discharge the oil to and from the third actuators 23E, 23F. Only one third directional control valve (53E or 53F) may be necessary to feed the oil from the two pumps 11, 12 to one third actuator (23E or 23F) (there is no need of two or more directional control valves). The third directional control valves 53E, 53F may be connected to the third feeding passage 43, the first unload passage 31, the second unload passage 32, and the tank passage 35. The third directional control valves 53E, 53F may be disposed downstream of the first directional control valves 51A, 51D and the second directional control valves 52B, 52C (in the downstream side of the unload passages 31, 32). The third directional control valves 53E, 53F may operate similarly to the second directional control valves 52B, 52C at some switching positions (see the boom-lowering position 53Fc of the boom-related directional control valve 53F (see FIG. 2)). The third directional control valves 53E, 53F may include the arm-related directional control valve 53E and the boom-related directional control valve 53F.

The arm-related directional control valve 53E may feed and discharge the oil to and from the arm cylinder 23E. The arm-related directional control valve 53E may be connected to the arm-related feeding passage 43E. As shown in FIG. 2, the switching positions of the arm-related directional control valve 53E may include an arm neutral position 53Ea and arm operation positions 53Eb, 53Ec.

The boom-related directional control valve 53F (the recycling directional control valve) may feed and discharge the oil to and from the boom cylinder 23F. As shown in FIG. 1, the boom-related directional control valve 53F may be disposed downstream of the other directional control valves (the directional control valves upstream of the boom-related directional control valve 53F on the unload passages 31, 32). The boom-related directional control valve 53F may be disposed downstream of the arm-related directional control valve 53E. The boom-related directional control valve 53F may be connected to the boom-related feeding passage 43F. The boom-related directional control valve 53F may be connected to the boom-lowering branch passage 42F1. The boom-related directional control valve 53F may be "the recycling directional control valve." The recycling directional control valve may be capable of feeding at least the discharge oil from the second pump 12 to the recycling actuator (the boom cylinder 23F in this embodiment).

Figure 2:
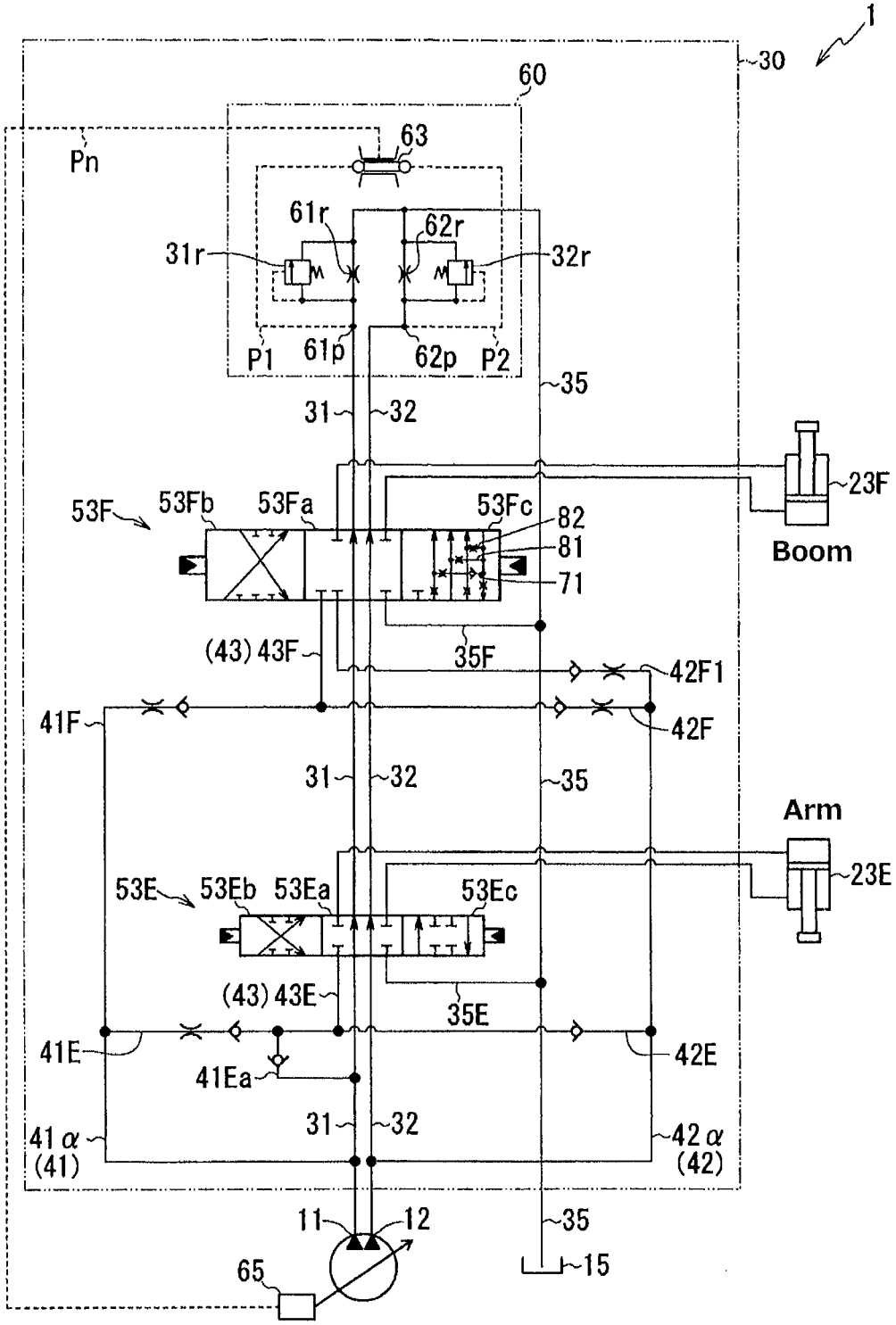
FIG. 2 is a hydraulic circuit diagram showing a part of the hydraulic circuit 30 for a construction machine shown in FIG. 1.

As shown in FIG. 2, the switching positions of the boom-related directional control valve 53F may include a boom neutral position 53Fa and boom operation positions 53Fb, 53Fc. The boom operation positions 53Fb, 53Fc may include a boom-raising position 53Fb and a boom-lowering position 53Fc. The boom-raising position 53Fb may be a switching position selected for raising the boom. The boom-lowering position 53Fc may be a switching position selected for lowering the boom. As shown in FIG. 3, the boom-lowering position 53Fc may include the boom-lowering branch passage 42F1, the first unload passage 31, the second unload passage 32, and the boom-related tank passage 35F.

As shown in FIG. 2, the negative control pressure sensing unit 60 may be provided for controlling the capacity of the pumps 11, 12 by negative control. The negative control pressure sensing unit 60 may output, as a negative control pressure Pn, the lower one of the pressure P1 (hydraulic pressure, sensing pressure) sensed at the first pressure sensing point 61*p* (described later) and the pressure P2 (hydraulic pressure, sensing pressure) sensed at the second pressure sensing point 62*p* (described later). The negative control pressure sensing unit 60 may include the first pressure sensing unit 61*p*, the second pressure sensing unit 62*p*, a first sensing pressure producing throttle 61*r*, a second sensing pressure producing throttle 62*r*, and a low pressure selecting unit 63.

The first pressure sensing point 61*p* may be disposed on the most downstream portion of the first unload passage 31. More specifically, the first pressure sensing unit 61*p* may be disposed on the first unload passage 31 downstream of the boom-related directional control valve 53F and upstream of the tank 15. The second pressure sensing point 62*p* may be disposed on the most downstream portion of the second unload passage 32. More specifically, the second pressure sensing unit 62*p* may be disposed on the second unload passage 32 downstream of the boom-related directional control valve 53F and upstream of the tank 15.

The first sensing pressure producing throttle 61*r* may produce a pressure P1 to be sensed at the first pressure sensing point 61*p*. The first sensing pressure producing throttle 61*r* may be disposed on the first unload passage 31 downstream of the first pressure sensing point 61*p*. The second sensing pressure producing throttle 62*r* may produce a pressure P2 to be sensed at the second pressure sensing point 62*p*. The second sensing pressure producing throttle 62*r* may be disposed on the second unload passage 32 downstream of the second pressure sensing point 62*p*.

The low pressure selecting unit 63 may select the lower one of the pressure P1 sensed at the first pressure sensing point 61*p* and the pressure P2 sensed at the second pressure sensing point 62*p*. The low pressure selecting unit 63 may output the selected pressure as the negative control pressure Pn. The low pressure selecting unit 63 may be, for example, a low pressure selecting valve that may include, for example, a shuttle valve. It may also be possible that the low pressure selecting unit 63 is not a valve. The low pressure selecting unit 63 may output the negative control pressure Pn as a hydraulic signal or may convert the negative control pressure Pn into an electric signal or the like for output (not shown).

The regulator 65 may control (vary) the discharge rates of the pumps 11, 12 in accordance with to the negative control pressure Pn output from the negative control pressure sensing unit 60 (from the low pressure selecting unit 63). The regulator 65 may vary the discharge rates of the pumps 11 and 12 by varying the tilt angles of the pumps 11 and 12 and varying the capacities of the pumps 11 and 12. The regulator 65 may control the discharge rates of the pumps 11, 12 by the negative control. More specifically, as a larger amount of oil flows (for service) from the pumps 11, 12 to the actuators 21A to 23F, a smaller amount of oil may flow through the unload passages 31, 32. As a result, the negative control pressure Pn sensed by the negative control pressure sensing unit 60 may decrease. Therefore, the regulator 65 may increase the discharge rates of the pumps 11, 12 as the negative control pressure Pn decreases. The regulator 65 may decrease the discharge rates of the pumps 11, 12 as the negative control pressure Pn increases.

The regulator 65 may control the discharge rates of the first pump 11 and the second pump 12 in association with each other. The regulator 65 may vary the discharge rates of the first pump 11 and the second pump 12 at the same time. When increasing the discharge rate of the first pump 11, the regulator 65 may also increase the discharge rate of the second pump 12. When decreasing the discharge rate of the first pump 11, the regulator 65 may also decrease the discharge rate of the second pump 12. The regulator 65 may keep the discharge rates of the first pump 11 and the second pump 12 equal (or substantially equal) to each other. Since one regulator 63 controls the discharge rates of the first pump 11 and the second pump 12, the cost of the regulator 65 can be reduced (as compared to the case where two regulators 65 individually control the discharge rates of the first pump 11 and the second pump 12).

Figure 3:
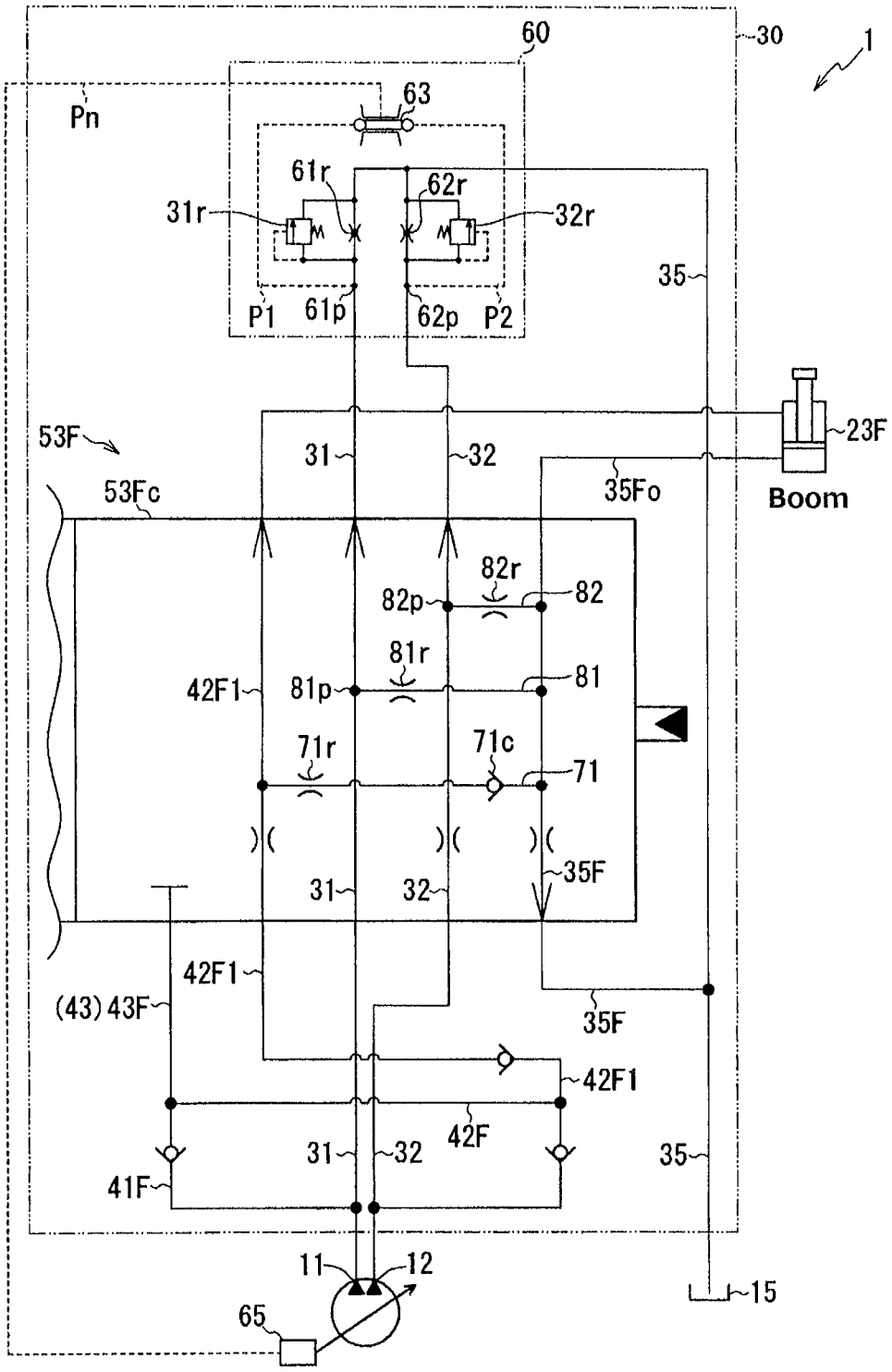
FIG. 3 is a hydraulic circuit diagram showing a part of the hydraulic circuit 30 for a construction machine shown in FIG. 2 in which a boom-lowering position 53Fc is selected.

As shown in FIG. 3, the recycling passage 71 may serve to perform pressure oil recycling. The recycling passage 71 may be connected to the boom cylinder 23F (the recycling actuator). The boom discharge oil 35Fo discharged from the boom cylinder 23F may flow into the recycling passage 71. The recycling passage 71 may feed the boom discharge oil 35Fo to the actuator (one of the second actuators 22B, 22C and the third actuators 23E, 23F) actuated with feeding of the discharge oil from the second pump 12. For example, the recycling passage 71 may feed the boom discharge oil 35Fo to the boom cylinder 23F. More specifically, the recycling passage 71 may be connected to the boom-related tank passage 35F and the boom-lowering branch passage 42F1.

The recycling passage 71 may be disposed (built) inside the boom-related directional control valve 53F. The recycling passage 71 may be disposed inside the valve in the boom-lowering position 53Fc. The recycling passage 71 may also be disposed outside the boom-related directional control valve 53F. If the recycling passage 71 is disposed outside the boom-related directional control valve 53F, there may be provided a valve for switching whether or not to use the recycling passage 71 (a valve other than the boom-related directional control valve 53F, not shown). On the recycling passage 71, there may be provided a check valve 71*c* and a throttle 71*r*.

The check valve 71*c* may prevent backflow of the oil from the boom-lowering branch passage 42F1 to the boom-related tank passage 35F. The throttle 71*r* may allow only a part of the boom discharge oil 35Fo to flow through the recycling passage 71.

The sensing pressure rising passages 81, 82 may serve to increase the negative control pressure Pn sensed by the negative control pressure sensing unit 60. The sensing pressure rising passages 81, 82 may include a first sensing pressure rising passage 81 and a second sensing pressure rising passage 82.

The first sensing pressure rising passage 81 may increase the pressure P1 sensed at the first pressure sensing point 61*p* when the pressure oil is recycled through the recycling passage 71. The first sensing pressure rising passage 81 may feed a part of the boom discharge oil 35Fo to the first unload passage 31 upstream of the first pressure sensing point 61*p* when the pressure oil is recycled (described later). The first sensing pressure rising passage 81 may not feed the boom discharge oil 35Fo to the first unload passage 31 when the pressure oil is not recycled. The first sensing pressure rising passage 81 may be connected to the boom-related tank passage 35F and may be connected to the boom cylinder 23F via the boom-related tank passage 35F. The first sensing pressure rising passage 81 may be connected to the first unload passage 31 upstream of the first pressure sensing point 61*p*. The first sensing pressure rising passage 81 may be connected to the first unload passage 31 at a connection position 81*p*.

The first sensing pressure rising passage 81 may be disposed inside the boom-related directional control valve 53F. The first sensing pressure rising passage 81 may be disposed inside the valve in the boom-lowering position 53Fc. The first sensing pressure rising passage 81 may also be disposed outside the boom-related directional control valve 53F. If the first sensing pressure rising passage 81 is disposed outside the boom-related directional control valve 53F, there may be provided a valve for switching whether or not to use the first sensing pressure rising passage 81 in accordance with whether or not the pressure oil is recycled (an acceleration switching valve other than the boom-related directional control valve 53F, not shown). A throttle 81*r* may be provided on the first sensing pressure rising passage 81. The throttle 81*r* may allow only a part of the boom discharge oil 35Fo to flow through the first sensing pressure rising passage 81.

The second sensing pressure rising passage 82 may increase the pressure P2 sensed at the first pressure sensing point 62*p* when the pressure oil is recycled through the recycling passage 71. The second sensing pressure rising passage 82 may feed a part of the boom discharge oil 35Fo to the second unload passage 32 upstream of the second pressure sensing point 62*p* when the pressure oil is recycled (described later). The second sensing pressure rising passage 82 may not feed the boom discharge oil 35Fo to the second unload passage 32 when the pressure oil is not recycled. The second sensing pressure rising passage 82 may be connected to the boom-related tank passage 35F and may be connected to the boom cylinder 23F via the boom-related tank passage 35F. The second sensing pressure rising passage 82 may be connected to the second unload passage 32 upstream of the second pressure sensing point 62*p*. The second sensing pressure rising passage 82 may be connected to the second unload passage 32 at a connection position 82*p*.

The second sensing pressure rising passage 82 may be disposed inside the boom-related directional control valve 53F. The second sensing pressure rising passage 82 may be disposed inside the valve in the boom-lowering position 53Fc. The second sensing pressure rising passage 82 may also be disposed outside the boom-related directional control valve 53F, as may be the first sensing pressure rising passage 81. A throttle 82*r* may be provided on the second sensing pressure rising passage 82. The throttle 82*r* may allow only a part of the boom discharge oil 35Fo to flow through the second sensing pressure rising passage 82.

Operation

The construction machine 1 shown in FIG. 1 may operate as follows.

Operation of the Directional Control Valves 51A to 53F

The directional control valves 51A to 53F may operate in accordance with the operation (lever operation) of the construction machine 1 by an operator. The directional control valves 51A to 53F may be switched between the switching positions in accordance with the lever operation. Upon switching between the switching positions, the directional control valves 51A to 53F may be switched between different feeding rates of the oil and whether or not to feed the oil to the actuators 21A to 23F. The first directional control valves 51A, 51D may block or throttle the first unload passage 31 thereby to feed the discharge oil from the first pump 11 to the first actuators 21A, 21D. More specifically, the first directional control valves 51A, 51D may block or throttle the first unload passage 31 in accordance with the amount of the lever operation. The first directional control valves 51A, 51D may feed the discharge oil from the first pump 11 through the first feeding passage 41 to the first actuators 21A, 21D. The second directional control valves 52B, 52C may block or throttle the second unload passage 32 thereby to feed the discharge oil from the second pump 12 to the second actuators 22B, 22C. More specifically, the second directional control valves 52B, 52C may block or throttle the second unload passage 32 in accordance with the amount of the lever operation. The second directional control valves 52B, 52C may feed the discharge oil from the second pump 12 through the second feeding passage 42 to the second actuators 22B, 22C.

Operation of the Third Directional Control Valves 53E, 53F

The third directional control valves 53E, 53F shown in FIG. 2 may generally operate as follows (except for the boom-lowering position 53Fc). The third directional control valves 53E, 53F may adjust the degrees of opening the first unload passage 31 and the second unload passage 32 in accordance with the lever operation (the operation of the third directional control valves 53E, 53F). The third directional control valves 53E, 53F may adjust the degrees of opening, thereby to adjust the flow rate of the oil flowing from the first feeding passage 41 and the second feeding passage 42 into the third feeding passage 43. With the adjustment of the flow rates, the third directional control valves 53E, 53F may adjust the flow rate of the oil fed to the third actuators 23E, 23F.

Operation of the Arm-Related Directional Control Valve 53F.

The operation of the arm-related directional control valve 53E will now be described. (Arm neutral position 53Ea) When in the arm neutral position 53Ea, the arm-related directional control valve 53E may not feed the oil to the arm cylinder 23E. More specifically, when in the arm neutral position 53Ea, the arm-related directional control valve 53E may fully open the first unload passage 31 and the second unload passage 32 and block (fully close) the third feeding passage 43 and the tank passage 35. (Arm operation positions 53Eb, 53Ec) When in the arm operation positions 53Eb, 53Ec, the arm-related directional control valve 53E may feed the oil to the arm cylinder 23E. More specifically, when in the operation positions 53Eb, 53Ec, the arm-related directional control valve 53E may block or throttle (cause throttling of) the first unload passage 31 and the second unload passage 32 (described later). Also, when in the arm operation positions 53Eb, 53Ec, the arm-related directional control valve 53E may unblock or throttle (fully open or cause throttling of) the third feeding passage 43 and the tank passage 35. Unblocking refers to fully open state or almost fully open state (where the passages may be throttled slightly). As a result, the oil flowing through the first feeding passage 41 and the oil flowing through the second feeding passage 42 may join together in the third feeding passage 43 (an exception thereof will be described later). The oil flowing through the third feeding passage 43 may be fed to the arm cylinder 23E, and the oil discharged from the arm cylinder 23E may flow into the tank passage 35. As a result, the arm may be rotated with respect to the boom.

Operation of the Boom-Related Directional Control Valve 53F

The operation of the boom-related directional control valve 53F will now be described, (Boom neutral position 53Ea) When in the boom neutral position 53Fa, the boom-related directional control valve 53F may not feed the oil to the boom cylinder 23F. More specifically, when in the boom neutral position 53Fa, the boom-related directional control valve 53F may fully open the first unload passage 31 and the second unload passage 32 and block the third feeding passage 43 and the tank passage 35. (Boom-raising position 53Fb) When in the boom-raising position 53Fb, the boom-related directional control valve 53F may feed the oil to the boom cylinder 23F. More specifically, when in the boom-raising position 53Fb, the boom-related directional control valve 53F may block or throttle the first unload passage 31 and the second unload passage 32 (described later). Also, when in the boom-raising position 53Fb, the boom-related directional control valve 53F may unblock or throttle the third feeding passage 43 and the tank passage 35. As a result, the oil flowing through the first feeding passage 41 and the oil flowing through the second feeding passage 42 may join together in the third feeding passage 43 (an exception thereof will be described later). The oil flowing through the third feeding passage 43 may be fed to the boom cylinder 23F, and the oil discharged from the boom cylinder 23F may flow into the tank passage 35. As a result, the boom may be raised.

(The boom-lowering position 53Fc) When the boom-lowering position 53Fc is selected, the boom-related directional control valve 53F may operate in the same manner as the second directional control valves 52B, 52C. When in the boom-lowering position 53Fc, the boom-related directional control valve 53F may feed the oil from the second feeding passage 42 to the boom cylinder 23F and may not feed the oil from the third feeding passage 43 (the boom-related feeding passage 43F) to the boom cylinder 23F. When the boom is lowered, the oil may be fed only from the second feeding passage 42 to the boom-related feeding passage 43F, not from the first feeding passage 41. More specifically, when in the boom-lowering position 53Fc, the boom-related directional control valve 53F may unblock the first unload passage 31 (keep the first unload passage 31 unblocked, or keep it fully opened or almost fully opened). When in the boom-lowering position 53Fc, the boom-related directional control valve 53F may block the boom-related feeding passage 43F (the third feeding passage 43). As with the second directional control valves 52B, 52C, the boom-related directional control valve 53F in the boom-lowering position 53Fc may block or throttle the second unload passage 32. As with the second directional control valves 52B, 52C, the boom-related directional control valve 53F in the boom-lowering position 53Fc may unblock or throttle the boom-lowering branch passage 42F1 (the second feeding passage 42) and the tank passage 35. As a result, the discharge oil from the second pump 12 may flow into the boom-lowering branch passage 42F1 (the second feeding passage 42), the oil flowing through the boom-lowering branch passage 42F1 may be fed to the boom cylinder 23F, and the oil discharged from the boom cylinder 23F may flow into the tank passage 35. As a result, the boom may be lowered.

(Variation of the boom-lowering Operation) When the boom-lowering position 53Fc is selected, the discharge oil from the second pump 12 may be fed to the boom cylinder 23F via the boom-related feeding passage 43F, not the boom-lowering branch passage 42F1 (this operation is not shown). In this operation, the boom-related directional control valve 53F in the boom-lowering position 53Fc may unblock the first unload passage 31 and block or throttle the second unload passage 32. Also, the boom-related directional control valve 53F in the boom-lowering position 53Fc may unblock or throttle the boom-related feeding passage 43F and the tank passage 35. In this variation, the boom-lowering branch passage 42F1 may be unnecessary, and the hydraulic circuit 30 for a construction machine can be simplified.

Operation Around the Recycling Passage 71

When the boom-lowering position 53Fc is selected as shown in FIG. 3, the recycling passage 71 and other elements may operate as follows. The boom discharge oil 35Fo may be discharged from the boom cylinder 23F (the bottom chamber) to the boom-related tank passage 35F due to the weight of the boom. A part of the boom discharge oil 35Fo may pass through the recycling passage 71 to be fed to the boom-lowering branch passage 42F1. As a result, a part of the boom discharge oil 35Fo may be fed to the boom cylinder 23F (the rod chamber) (and used as a recycling pressure oil).

Operation Around the First Sensing Pressure Rising Passage 81

When the boom-lowering position 53Fc is selected, the first sensing pressure rising passage 81 and other elements may operate as follows. As described above, the boom discharge oil 35Fo may flow through the boom-related tank passage 35F due to the weight of the boom. A part of the boom discharge oil 35Fo may be fed from the boom-related tank passage 35F through the first sensing pressure rising passage 81 to the first unload passage 31 upstream of the first pressure sensing point 61*p*. As a result, the pressure at the connection position 81*p* may be increased. Therefore, the pressure P1 sensed at the first pressure sensing point 61*p* may be increased. If the pressure P1 is the negative control pressure Pn (the pressure P1 is smaller than the pressure P2), the negative control pressure Pn may be increased with the increased pressure P1. As a result, the regulator 65 may reduce the discharge rates of the first pump 11 and the second pump 12. When the boom is lowered, the pressure oil may be recycled through the recycling passage 71 as described above, and thus the discharge rate of the second pump 12 may become excessive (the necessary discharge rate is reduced). Therefore, the discharge rate of the second pump 12 may be reduced as described above, and thus less energy may be consumed by the second pump 12 feeding excessive discharge oil.

Operation Around the First Sensing Pressure Rising Passage 81 in Simultaneous Operation of the Boom and the Arm or the Like When the boom-lowering position 53Fc shown in FIG. 2 is selected and the first unload passage 31 is blocked or throttled by the directional control valves 51A to 53E upstream of the boom-related directional control valve 53F, the elements may operate as follows. By way of a specific example, operation in lowering the boom and simultaneously operating the arm will be described. When the arm is operated, the arm operation positions 53Eb, 53Ec may be selected, and the first unload passage 31 may be blocked or throttled (the second unload passage 32 may also be blocked or throttled). As a result, the pressure in the first unload passage 31 downstream of the arm-related directional control valve 53E may be reduced (as compared to the case where the arm neutral position 53Ea is selected). Therefore, the pressure P1 may tend to be the negative control pressure Pn. At this time, the first sensing pressure rising passage 81 may increase the pressure P1, and thus the negative control pressure Pn may tend to be increased.

Operation Around the Second Sensing Pressure Rising Passage 82

When the boom-lowering position 53Fc is selected as shown in FIG. 3, the second sensing pressure rising passage 82 and other elements may operate as follows. As described above, the boom discharge oil 35Fo may flow through the boom-related tank passage 35F due to the weight of the boom. A part of the boom discharge oil 35Fo may be fed from the boom-related tank passage 35F through the second sensing pressure rising passage 82 to the second unload passage 32 upstream of the second pressure sensing point 62*p*. As a result, the pressure at the connection position 82*p* may be increased. Therefore, the pressure P2 sensed at the first pressure sensing point 62*p* may be increased. If the pressure P2 is the negative control pressure Pn (the pressure P2 is smaller than the pressure P1), the negative control pressure Pn may be increased with the increased pressure P2. As a result, the regulator 65 may reduce the discharge rates of the first pump 11 and the second pump 12. Therefore, as described above, less energy may be consumed by the second pump 12 feeding excessive discharge oil.

Advantage 1 (Invention 1)

An advantage produced by the hydraulic circuit 30 for a construction machine shown in FIG. 1 will now be described. The hydraulic circuit 30 for a construction machine may be connected to a first pump 11, a second pump 12, a tank 15, and a plurality of actuators 21A to 23F. The hydraulic circuit 30 for a construction machine may include a first unload passage 31 connected to the first pump 11, a second unload passage 32 connected to the second pump 12, a first unload passage 31, a second unload passage 32, and a tank passage 35 connected to the tank 15. Further, the hydraulic circuit 30 for a construction machine may include directional control valves 51A to 53F, a negative control pressure sensing unit 60, and a regulator 65. Further, as shown in FIG. 2, the hydraulic circuit 30 for a construction machine may include a recycling passage 71 connected to a boom cylinder 23F (the recycling actuator) which may constitute a part of the plurality of actuators 21A to 23F, and sensing pressure rising passages 81, 82 (at least one of a first sensing pressure rising passage 81 and a second sensing pressure rising passage 82) connected to the boom cylinder 23F. The directional control valves 51A to 53F may feed oil from the first pump 11 or the second pump 12 to the actuators 21A to 23F and discharge the oil discharged from the actuators 21A to 23F to the tank 15. The directional control valves 51A to 53F may be connected to the plurality of actuators 21A to 23F, respectively.

(Configuration 1-1) The negative control pressure sensing unit 60 may output, as a negative control pressure Pn, the lower one of the pressure P1 sensed at the first pressure sensing point 61*p* in the most downstream portion of the first unload passage 31 and the pressure P2 sensed by the second pressure sensing unit 62*p* in the most downstream portion of the second unload passage 32.

(Configuration 1-2) The regulator 65 may control the discharge rates of the first pump 11 and the second pump 12 in association with each other in accordance with the negative control pressure Pn output from the negative control pressure sensing unit 60.

(Configuration 1-3) The directional control valves 51A to 53F may include a boom-related directional control valve 53F (the recycling directional control valve) for feeding the discharge oil from the second pump 12 to the boom cylinder 23F.

(Configuration 1-4) As shown in FIG. 3, the recycling passage 71 may perform the "pressure oil recycling," in which the recycling passage 71 may feed the boom discharge oil 35Fo discharged from the boom cylinder 23F, to the actuator (for example, the boom cylinder 23F) actuated with feeding of the discharge oil from the second pump 12.

(Configuration 1-5) This configuration may include Configuration 1-5A described below or Configuration 1-5B.

(Configuration 1-5A) The first sensing pressure rising passage 81 may feed a part of the boom discharge oil 35Fo to the first unload passage 31 upstream of the first pressure sensing point 61*p* when the pressure oil is recycled.

(Configuration 1-5B) The second sensing pressure rising passage 82 may feed a part of the boom discharge oil 35Fo to the second unload passage 32 upstream of the second pressure sensing point 62*p* when the pressure oil is recycled.

The hydraulic circuit 30 for a construction machine may have Configuration 1-3 and Configuration 1-4 described above. Therefore, when the pressure oil is recycled, the necessary discharge rate of the second pump 12 may be reduced. The hydraulic circuit 30 for a construction machine may have Configuration 1-5A or Configuration 1-5B described above. Therefore, the hydraulic circuit 30 for a construction machine may produce Advantage 1A or Advantage 1B described below.

Advantage 1A

The hydraulic circuit 30 for a construction machine may have Configuration 1-1 and Configuration 1-2 described above. Therefore, when the pressure P1 is lower than the pressure P2 (when the pressure P1<the pressure P2), the discharge rates of the first pump 11 and the second pump 12 may be controlled in association with each other based on the pressure P1 (equal to the negative control pressure Pn). Therefore, in the case where the pressure P1<the pressure P2, the discharge rate of the second pump 12 may not be reduced, though the necessary discharge rate of the second pump 12 is reduced by the pressure oil recycling. To overcome this problem, the hydraulic circuit 30 for a construction machine may have Configuration 1-5A described above. The action of the first sensing pressure rising passage 81 can increase the pressure P1. When the pressure P1<the pressure P2, the negative control pressure Pn can be increased. Thus, the discharge rate of the second pump 12 can be reduced, and energy consumption for actuating the second pump 12 can be reduced. When the discharge rate of the second pump 12 is reduced, the discharge rate of the first pump 11 may also be reduced, thereby reducing the energy consumption for actuating the first pump 11.

Advantage 1B

The hydraulic circuit 30 for a construction machine may have Configuration 1-1 and Configuration 1-2 described above. Therefore, when the pressure P1 is higher than the pressure P2 (when the pressure P1>the pressure P2), the discharge rates of the first pump 11 and the second pump 12 may be controlled based on the pressure P2 (equal to the negative control pressure Pn). The hydraulic circuit 30 for a construction machine may have Configuration 1-5B described above. The action of the second sensing pressure rising passage 82 can increase the pressure P2. When the pressure P1>the pressure P2, the negative control pressure Pn can be increased. Thus, the discharge rate of the second pump 12 can be reduced, and energy consumption for actuating the second pump 12 can be reduced. When the discharge rate of the second pump 12 is reduced, the discharge rate of the first pump 11 may also be reduced, thereby reducing the energy consumption for actuating the first pump 11.

The hydraulic circuit 30 for a construction machine may produce Advantage 1A and Advantage 1B described above. Therefore, in the hydraulic circuit 30 for a construction machine configured such that the discharge rates of the fist pump 11 and the second pump 12 are controlled in association with each other, when the pressure oil recycling is conducted and the second pump 12 has excess discharge oil, the discharge rate of the second pump 12 can be readily reduced. As a result, energy consumption for actuating the second pump 12 can be restrained.

Advantage 2 (Invention 2)

(Configuration 2) The sensing pressure rising passages 81, 82 may include a first sensing pressure rising passage 81 for feeding a part of the boom discharge oil 35Fo to the first unload passage 31 upstream of the first pressure sensing point 61*p* when the pressure oil is recycled.

Configuration 2 described above may produce Advantage 1A.

Advantage 3 (Invention 3)

(Configuration 3) The sensing pressure rising passages 81, 82 may include a second sensing pressure rising passage 82 for feeding a part of the boom discharge oil 35Fo to the second unload passage 32 upstream of the second pressure sensing point 62*p* when the pressure oil is recycled.

With Configuration 2 and Configuration 3, both Advantage 1A and Advantage 1B can be produced.

Advantage 4 (Invention 4)

(Configuration 4) The first sensing pressure rising passage 81 may be disposed inside the boom-related directional control valve 53F.

With Configuration 4, it may be possible to eliminate the valve for switching whether or not to use the first sensing pressure rising passage 81 (an acceleration switching valve) other than the boom-related directional control valve 53F. It may also be possible to eliminate the space for disposing the first sensing pressure rising passage 81 outside the boom-related directional control valve 53F.

Advantage 5 (Invention 5)

(Configuration 5) The recycling directional control valve may be the boom-related directional control valve 53F.

With Configuration 5, Advantage 1A or Advantage 1B can be produced when the boom cylinder 23F connected to the boom-related directional control valve 53F is operated (for example, for lowering the boom).

Other Advantages (Other Configuration 1) The second sensing pressure rising passage 82 may be disposed inside the boom-related directional control valve 53F.

With Other Configuration 1, it may be possible to eliminate the valve for switching whether or not to use the second sensing pressure rising passage 82 (an acceleration switching valve) other than the boom-related directional control valve 53F. It may also be possible to eliminate the space for disposing the second sensing pressure rising passage 82 outside the boom-related directional control valve 53F.

Second Embodiment

Figure 4:
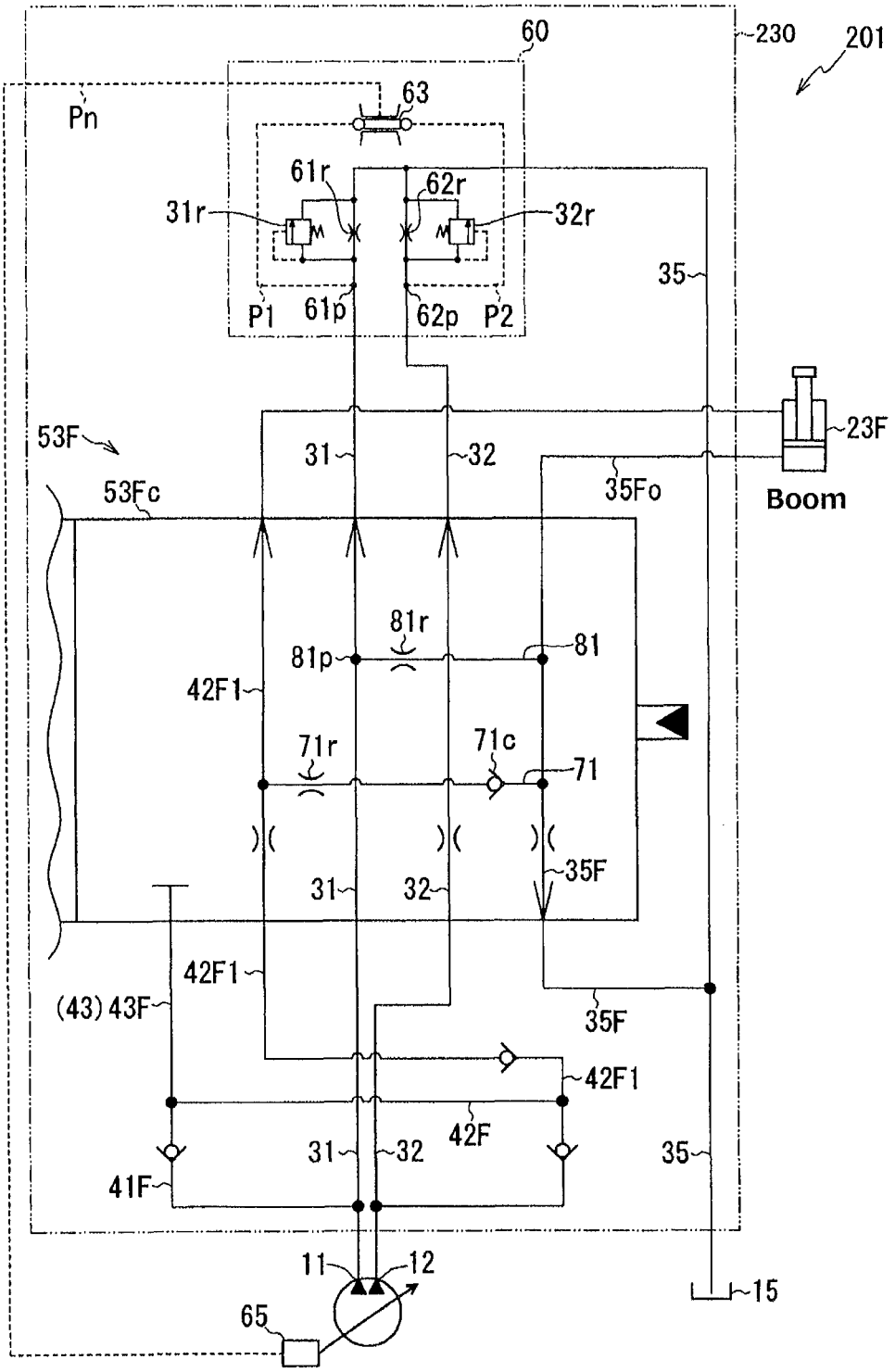
FIG. 4 corresponds to FIG. 3 for the second embodiment.

With reference to FIG. 4, the hydraulic circuit 230 for a construction machine used in the construction machine 201 of the second embodiment will be described with respect to the differences from the first embodiment. The elements of the construction machine 201 of the second embodiment that are common to the first embodiment are denoted with the same reference signs as for the first embodiment and description thereof will be omitted (these common elements also will not be described for other embodiments). The hydraulic circuit 30 for a construction machine of the first embodiment shown in FIG. 3 may include the second sensing pressure rising passage 82, but the hydraulic circuit 230 for a construction machine of the second embodiment shown in FIG. 4 may not include the second sensing pressure rising passage 82 (see FIG. 3).

The hydraulic circuit 230 for a construction machine of the second embodiment may have Configuration 2 described above and thus may produce Advantage 1A.

Third Embodiment

Figure 5:
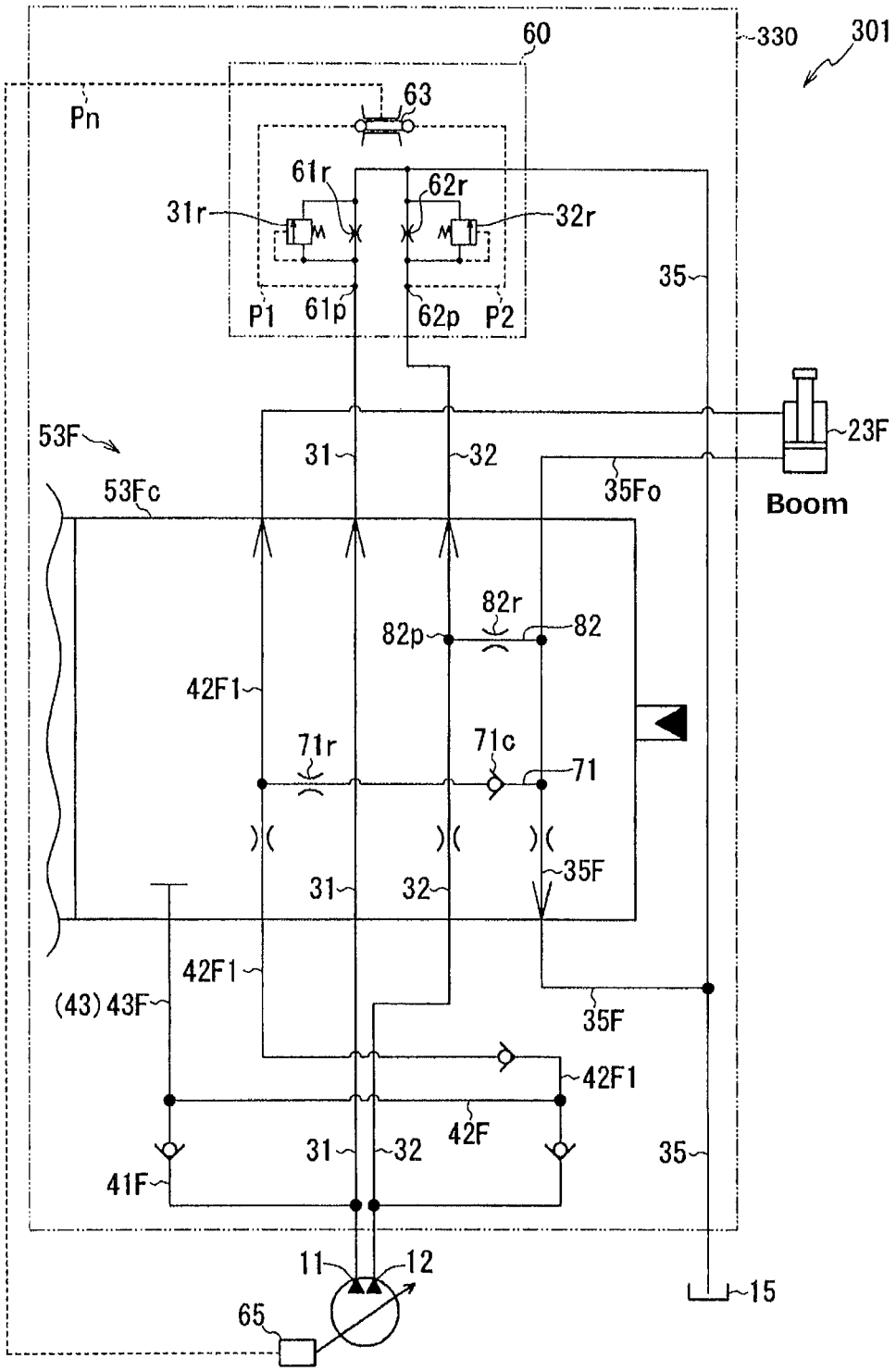
FIG. 5 corresponds to FIG. 3 for the third embodiment.

With reference to FIG. 5, the hydraulic circuit 330 for a construction machine used in the construction machine 301 of the third embodiment will be described with respect to the differences from the first embodiment. The hydraulic circuit 30 for a construction machine of the first embodiment shown in FIG. 3 may include the first sensing pressure rising passage 81, but the hydraulic circuit 330 for a construction machine of the third embodiment shown in FIG. 5 may not include the first sensing pressure rising passage 81 (see FIG. 3).

Advantage 6 (Invention 7)

The hydraulic circuit 330 for a construction machine of the third embodiment may have Configuration 3 described above and thus may produce Advantage 1B.

Fourth Embodiment

Figure 6:
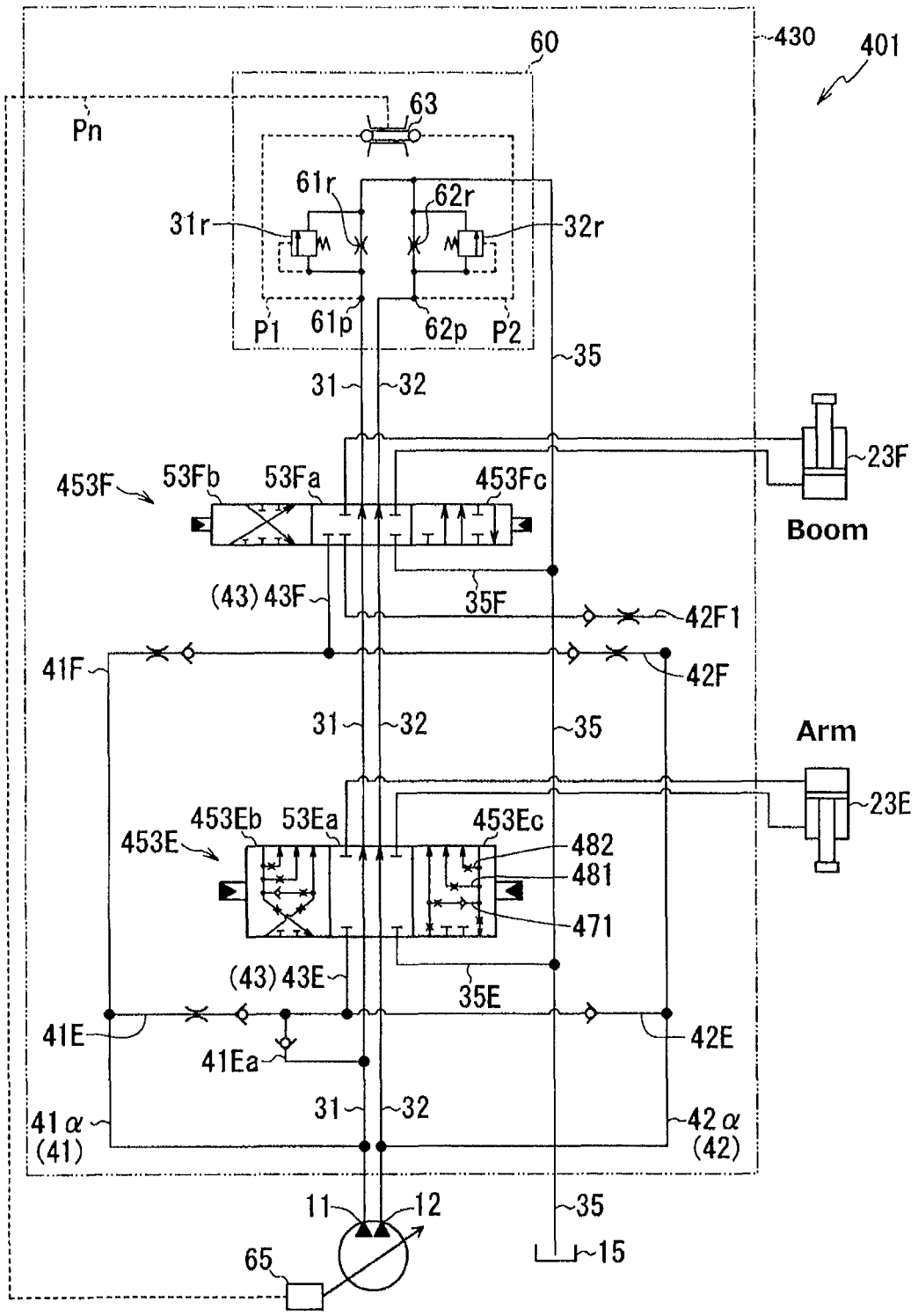
FIG. 6 corresponds to FIG. 2 for the fourth embodiment.
Figure 7:
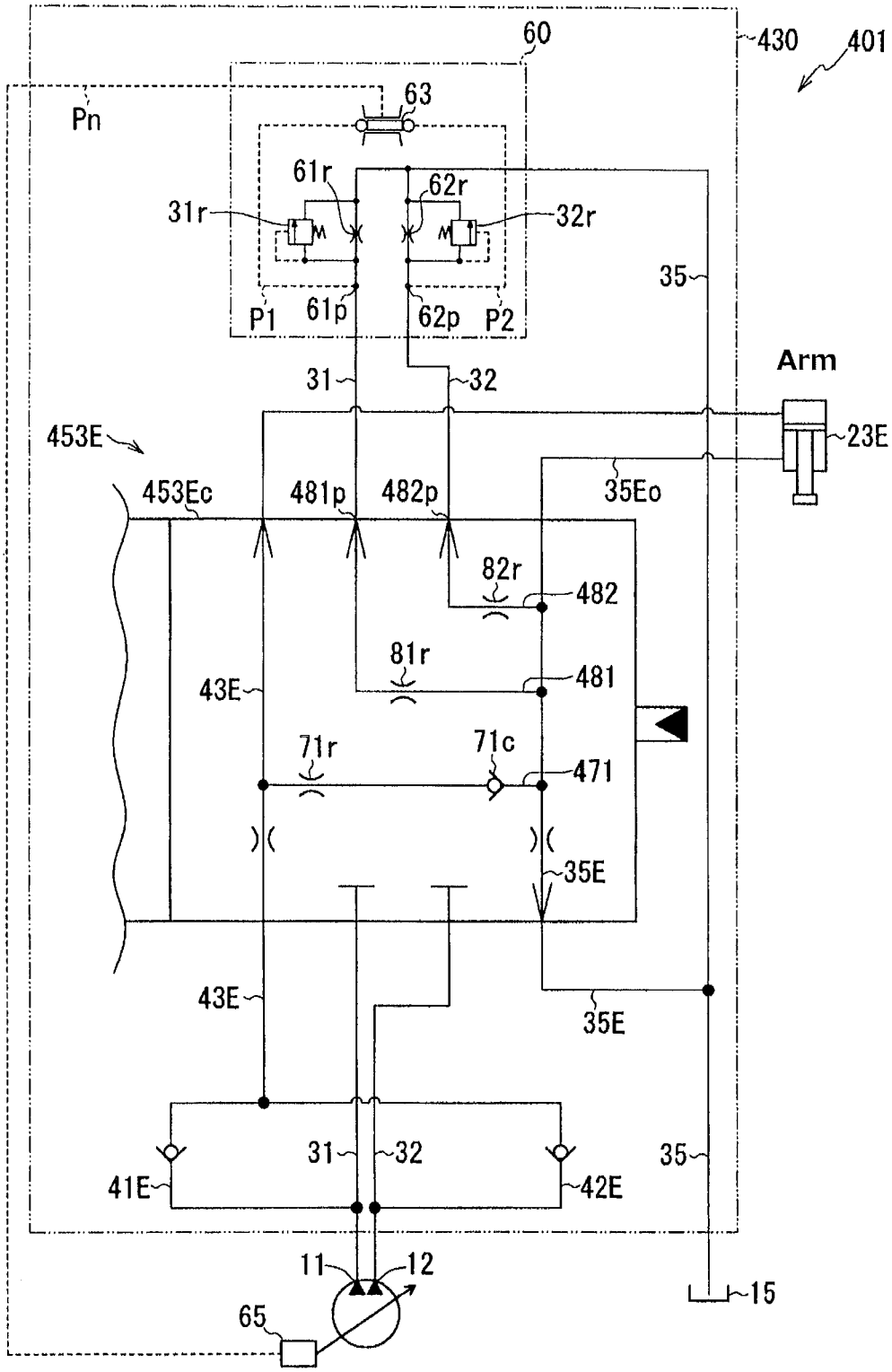
FIG. 7 is a hydraulic circuit diagram showing a part of a hydraulic circuit 430 for a construction machine shown in FIG. 6 in which an arm operation position 53Ec is selected.

With reference to FIGS. 6 and 7, the hydraulic circuit 430 for a construction machine used in the construction machine 401 of the fourth embodiment will be described with respect to the differences from the first embodiment. In the hydraulic circuit 30 for a construction machine of the first embodiment shown in FIG. 2, the recycling actuator may be the boom cylinder 23F, and the recycling directional control valve may be the boom-related directional control valve 53F. In addition, the recycling passage 71 and the sensing pressure rising passages 81, 82 may be connected to the boom cylinder 23F. By contrast, in the hydraulic circuit 430 for a construction machine of the fourth embodiment shown in FIG. 6, the recycling actuator may be the arm cylinder 23E, and the recycling directional control valve may be the arm-related directional control valve 453E. In addition, the recycling passage 471 and the sensing pressure rising passages 481, 482 may be connected to the arm cylinder 23E instead of the boom cylinder 23F. The hydraulic circuit 430 for a construction machine may include the boom-related directional control valve 453F which may not be a recycling directional control valve. The above differences will be further described below.

The boom-related directional control valve 453F may have a boom-lowering position 453Fc. Unlike the boom-lowering position 53Fc of the first embodiment (see FIG. 2), the recycling passage 71 and the sensing pressure rising passages 81, 82 may not be disposed inside the valve in the boom-lowering position 453Fc.

The arm-related directional control valve 453E (a recycling directional control valve) may feed oil to the arm cylinder 23E which is a recycling actuator.

The recycling passage 471, the first sensing pressure rising passage 481, and the second sensing pressure rising passage 482 may be each configured to be usable when the arm operation position 453Eb or the arm operation position 453Ec is selected. The recycling passage 471, the first sensing pressure rising passage 481, and the second sensing pressure rising passage 482 may be each disposed inside (or outside) both the arm operation position 453Eb and the arm operation position 453Ec. Of the two arm operation positions 453Eb, 453Ec (see FIG. 6), an enlarged view of the arm operation position 453Ec is shown in FIG. 7.

As shown in FIG. 7, the recycling passage 471 may feed a part of the arm discharge oil 35Eo (recycling discharge oil) discharged from the arm cylinder 23E, to the arm cylinder 23E via the arm-related feeding passage 43E. More specifically, the recycling passage 471 may be connected to the arm cylinder 23E. The recycling passage 471 may be connected to the arm-related tank passage 35E and the arm-related feeding passage 43E. The recycling passage 471 may be disposed inside (or outside) the arm-related directional control valve 453E.

The first sensing pressure rising passage 481 may feed a part of the arm discharge oil 35Eo to the first unload passage 31 upstream of the first pressure sensing point 61*p* when the pressure oil is recycled through the recycling passage 471. The first sensing pressure rising passage 481 may be connected to the arm-related tank passage 35E and may be connected to the arm cylinder 23E via the arm-related tank passage 35E. The first sensing pressure rising passage 481 may be connected to the first unload passage 31 upstream of the first pressure sensing point 61*p*. The first sensing pressure rising passage 481 may be connected to the first unload passage 31 at a connection position 481*p*. The first sensing pressure rising passage 481 may be disposed inside (or outside) the arm-related directional control valve 453E.

The second sensing pressure rising passage 482 may feed a part of the arm discharge oil 35Eo to the second unload passage 32 upstream of the second pressure sensing point 62*p* when the pressure oil is recycled through the recycling passage 471. The second sensing pressure rising passage 482 may be connected to the arm-related tank passage 35E and may be connected to the arm cylinder 23E via the arm-related tank passage 35E. The second sensing pressure rising passage 482 may be connected to the second unload passage 32 upstream of the second pressure sensing point 62*p*. The second sensing pressure rising passage 482 may be connected to the second unload passage 32 at a connection position 482*p*. The second sensing pressure rising passage 482 may be disposed inside (or outside) the arm-related directional control valve 453E.

Operation Around the Recycling Passage 471

When the arm operation position 453Eb (see FIG. 6) or the arm operation position 453Ec is selected and the arm is lowered, the recycling passage 471 and other elements may operate as follows. The arm discharge oil 35Eo may be discharged from the arm cylinder 23E to the arm-related tank passage 35E due to the weight of the arm. A part of the arm discharge oil 35Eo may pass through the recycling passage 471 to be fed to the arm-related feeding passage 43E. As a result, a part of the arm discharge oil 35Eo may be fed to the arm cylinder 23E (an oil chamber, either a bottom chamber or a rod chamber, from which the arm discharge oil 35Eo was not discharged) (and used as a recycling pressure oil). When the arm is raised by the arm cylinder 23E (when the arm is raised), the oil may not flow through the recycling passage 471 due to the action of the check valve 71*c*, and the pressure oil may not be recycled.

Operation Around the First Sensing Pressure Rising Passage 481

When the arm operation position 453Eb (see FIG. 6) or the arm operation position 453Ec is selected, the first sensing pressure rising passage 481 and other elements may operate as follows. When the arm is operated, the arm discharge oil 35Eo may flow through the arm-related tank passage 35E. A part of the arm discharge oil 35Eo may be fed from the arm-related tank passage 35E through the first sensing pressure rising passage 481 to the first unload passage 31 upstream of the first pressure sensing point 61*p*. As a result, the pressure at the connection position 481*p* may be increased. Therefore, when the first unload passage 31 is unblocked by the directional control valve (the boom-related directional control valve 453F (see FIG. 6)) downstream of the connection position 481*p*, the pressure P1 sensed by the first pressure sensing point 61*p* may be increased (described later).

Operation Around the First Sensing Pressure Rising Passage 481 in Simultaneous Operation of the Arm and the Boom or the Like The Case Where the Arm is Lowered and the Boom is Lowered, etc.

When the arm operation position 453Eb shown in FIG. 6 or the arm operation position 453Ec is selected and the first unload passage 31 is unblocked by the directional control valve (the boom-related directional control valve 453F) downstream of the arm-related directional control valve 453E, the elements may operate as follows. By way of a specific example, operation in lowering the arm and simultaneously lowering the boom will be described. As described above, when the boom is lowered, the boom-related directional control valve 453F in the boom-lowering position 453Fc may unblock the first unload passage 31. When the arm is lowered, the action of the first sensing pressure rising passage 481 may increase the pressure at the connection position 481*p* (see FIG. 7). As a result, the pressure P1 sensed by the first pressure sensing point 61*p* may be increased.

The Case where the Arm is Lowered and the Boom is Raised, Etc.

When the arm operation position 453Eb or the arm operation position 453Ec is selected and the first unload passage 31 is blocked or throttled by the directional control valve (for example, the boom-related directional control valve 453F) downstream of the arm-related directional control valve 453E, the elements may operate as follows. By way of a specific example, operation in lowering the arm and simultaneously raising the boom will be described. As described above, when the arm is lowered, the action of the first sensing pressure rising passage 481 may increase the pressure at the connection position 481*p* (see FIG. 7). On the other hand, when the boom is raised, the first unload passage 31 may be blocked or throttled by the boom-related directional control valve 453F in the boom-raising position 53Fb (the second unload passage 32 may also be blocked or throttled). As a result, the pressure P1 sensed by the first pressure sensing point 61*p* may be reduced in accordance with the amount of throttling of the first unload passage 31 by the boom-related directional control valve 453F. When the pressure P1 is the negative control pressure Pn, the pressure P1 may be reduced to reduce the negative control pressure Pn and increase the discharge rates of the first pump 11 and the second pump 12. Thus, the function of increasing the pressure P1 by the first sensing pressure rising passage 481 may be canceled (partially or totally). As a result, the rate necessary for raising the boom (operating the boom cylinder 23F) may be secured (for example, the full rate is available). Therefore, the efficiency of the work using the boom may be secured.

Action of the Second Sensing Pressure Rising Passage 482, etc.

When the arm operation position 453Eb or the arm operation position 453Ec shown in FIG. 7 is selected, the second sensing pressure rising passage 482 and other elements may operate as follows. As described above, when the arm is operated, the arm discharge oil 35Eo may flow through the arm-related tank passage 35E. A part of the arm discharge oil 35Eo may be fed from the arm-related tank passage 35E through the second sensing pressure rising passage 482 to the second unload passage 32 upstream of the second pressure sensing point 62*p*. As a result, the pressure at the connection position 482*p* may be increased. Therefore, when the second unload passage 32 shown in FIG. 6 is unblocked by the directional control valve (the boom-related directional control valve 453F) downstream of the connection position 482*p*, the pressure P2 sensed at the first pressure sensing point 62*p* may be increased. On the other hand, when the second unload passage 32 is blocked or throttled by the boom-related directional control valve 453F, the pressure P2 sensed at the first pressure sensing point 61*p* may be reduced in accordance with the amount of throttling. As a result, the negative control pressure Pn may be reduced and the discharge rates of the first pump 11 and the second pump 12 may be increased. Thus, the function of increasing the pressure P2 by the second sensing pressure rising passage 482 may be canceled (partially or totally).

Advantage 7 (Invention 6)

An advantage produced by the hydraulic circuit 430 for a construction machine shown in FIG. 6 will now be described. A plurality of directional control valves 51A to 53F (see FIG. 1) may include the arm-related directional control valve 453E, which is a recycling directional control valve, and the boom-related directional control valve 453F disposed downstream of the arm-related directional control valve 453E. The boom-related directional control valve 453F may have the boom-lowering position 453Fc and the boom-raising position 53Fb.

(Configuration 7-1) The boom-lowering position 453Fc may be selected for lowering the boom, and in this position, the first unload passage 31 may be unblocked.

(Configuration 7-2) The boom-raising position 53Fb may be selected for raising the boom, and in this position, the first unload passage 31 may be blocked or throttled. The hydraulic circuit 430 for a construction machine may include the first sensing pressure rising passage 481 in Configuration 2 described above.

When the boom-lowering position 453Fc in Configuration 7-1 described above is selected, the boom-related directional control valve 453F almost may not reduce the pressure in the first unload passage 31. Therefore, Advantage 1A described above may be produced. When the boom-raising position 53Fb in Configuration 7-2 described above is selected, the pressure P1 sensed at the first pressure sensing point 61*p* may be reduced in accordance with the amount of throttling of the first unload passage 31 at the boom-raising position 53Fb. At this time, when the pressure P1 is the negative control pressure Pn, the discharge rates of the first pump 11 and the second pump 12 may be increased Thus, the boom can be raised properly. The efficiency of the work using a construction machine can be secured.

Variations

The above embodiments can be modified variously. For example, parts of different embodiments may be combined together. For a specific example, the configuration of the first embodiment shown in FIG. 2 including the recycling passage 71 and the sensing pressure rising passages 81, 82 connected to the boom cylinder 23F may be combined with the configuration of the fourth embodiment shown in FIG. 6 including the recycling passage 471 and the sensing pressure rising passages 481, 482 connected to the arm cylinder 23E. For example, the hydraulic circuit 430 for a construction machine of the fourth embodiment may be modified to include only one of the sensing pressure rising passage 481 and the second sensing pressure rising passage 482. For example, an element (a throttle or a passage) not included in the hydraulic circuit 30 for a construction machine shown in FIG. 1 may be added. The positions at which the passages are connected in the hydraulic circuit 30 for a construction machine may be modified.

What is claimed is:

1. A hydraulic circuit for a construction machine, the hydraulic circuit being connected to a first pump, a second pump, a tank, and a plurality of actuators, the hydraulic circuit comprising:

a first unload passage connected to the first pump;

a second unload passage connected to the second pump;

a tank passage connected to the first unload passage, the second unload passage, and the tank;

a plurality of directional control valves connected to the plurality of actuators, respectively, and configured to feed an oil from the first pump or the second pump to the plurality of actuators and discharge to the tank the oil discharged from the plurality of actuators;

a negative control pressure sensing unit configured to output, as a negative control pressure, lower one of a pressure sensed at a first pressure sensing point in a most downstream portion of the first unload passage and a pressure sensed at a second pressure sensing point in a most downstream portion of the second unload passage;

a regulator configured to control discharge rates of the first pump and the second pump in association with each other in accordance with the negative control pressure output from the negative control pressure sensing unit;

a recycling passage connected to a recycling actuator included in the plurality of actuators; and a sensing pressure rising passage connected to the recycling actuator, wherein the plurality of directional control valves include a recycling directional control valve configured to feed discharge oil from the second pump to the recycling actuator, the recycling passage is configured to perform pressure oil recycling, in which the recycling passage feeds recycling discharge oil discharged from the recycling actuator, to the actuator actuated with feeding of the discharge oil from the second pump, and the sensing pressure rising passage is configured to feed a part of the recycling discharge oil to the first unload passage upstream of the first pressure sensing point or the second unload passage upstream of the second pressure sensing point when the pressure oil recycling is performed.

2. The hydraulic circuit for a construction machine according to claim 1, wherein the sensing pressure rising passage includes a first sensing pressure rising passage configured to feed a part of the recycling discharge oil to the first unload passage upstream of the first pressure sensing point when the pressure oil recycling is performed.

3. The hydraulic circuit for a construction machine according to claim 2, wherein the sensing pressure rising passage includes a second sensing pressure rising passage configured to feed a part of the recycling discharge oil to the second unload passage upstream of the second pressure sensing point when the pressure oil recycling is performed.

4. The hydraulic circuit for a construction machine according to claim 2, wherein the first sensing pressure rising passage is disposed inside the recycling directional control valve.

5. The hydraulic circuit for a construction machine according to claim 2, wherein the plurality of directional control valves include:

an arm-related directional control valve serving as the recycling directional control valve; and a boom-related directional control valve disposed downstream of the arm-related directional control valve, wherein the boom-related directional control valve has:

a boom-lowering position selected for lowering a boom, the boom-lowering position causing the first unload passage to be unblocked, and a boom-raising position selected for raising the boom, the boom-raising position causing the first unload passage to be blocked or throttled.

6. The hydraulic circuit for a construction machine according to claim 1, wherein the recycling directional control valve is a boom-related directional control valve or an arm-related directional control valve.

7. The hydraulic circuit for a construction machine according to claim 1, wherein the sensing pressure rising passage is configured to feed a part of the recycling discharge oil to the second unload passage upstream of the second pressure sensing point when the pressure oil recycling is performed.

* * * * *